US010061270B2

(12) United States Patent
Amano

(10) Patent No.: US 10,061,270 B2
(45) Date of Patent: Aug. 28, 2018

(54) POINTER AND POINTER MANUFACTURING METHOD

(71) Applicant: CASIO COMPUTER CO., LTD., Tokyo (JP)

(72) Inventor: Masao Amano, Uenohara (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 1181 days.

(21) Appl. No.: 13/959,436

(22) Filed: Aug. 5, 2013

(65) Prior Publication Data

US 2014/0064046 A1 Mar. 6, 2014

(30) Foreign Application Priority Data

Aug. 30, 2012 (JP) ..... 2012-189360
May 14, 2013 (JP) ..... 2013-101828

(51) Int. Cl.
*G04B 19/04* (2006.01)

(52) U.S. Cl.
CPC ..... *G04B 19/042* (2013.01); *Y10T 156/1052* (2015.01)

(58) Field of Classification Search
None
See application file for complete search history.

(56) References Cited

U.S. PATENT DOCUMENTS 6,790,506 B2 9/2004 Lin et al.
7,618,183 B2 11/2009 Meister et al.
7,656,752 B2 2/2010 Arita et al.
2001/0049246 A1 12/2001 Lin et al.
2006/0216682 A1* 9/2006 McNay ..... G09B 19/12 434/304
2009/0233044 A1 9/2009 Sun et al.

FOREIGN PATENT DOCUMENTS

| | | | |
|---|---|---|---|
| CN | 1236123 | A | 11/1999 |
| CN | 2403028 | Y | 10/2000 |
| CN | 101532253 | A | 9/2009 |
| JP | 62-195790 | U | 12/1987 |
| JP | 63-195284 | U | 12/1988 |
| JP | 63-303732 | A | 12/1988 |
| JP | 04-095892 | A | 3/1992 |
| JP | 05-135775 | A | 6/1993 |
| JP | 11-352249 | A | 12/1999 |
| JP | 2002-069811 | A | 3/2002 |
| JP | 2009-508084 | A | 2/2009 |
| JP | 2009-074880 | A | 4/2009 |
| WO | WO 2006/122873 | A1 | 11/2006 |

OTHER PUBLICATIONS

Machine translation of CN2403028, Oct. 2000, Liang.*
Japanese Office Action dated Oct. 16, 2013 (and English translation thereof) issued in counterpart Japanese Application No. 2013-101828.
Chinese Office Action (and English translation thereof) dated Nov. 4, 2015, issued in counterpart Chinese Application No. 201310383110.6.

* cited by examiner

*Primary Examiner* — Shawn Mckinnon
(74) *Attorney, Agent, or Firm* — Holtz, Holtz & Volek PC

(57) ABSTRACT

A pointer including a pointer body made of a material sheet formed by a plurality of fiber sheets having carbon fibers arranged in one direction being laminated together with arrangement directions of the carbon fibers being varied.

11 Claims, 9 Drawing Sheets

POINTER AND POINTER MANUFACTURING METHOD

CROSS-REFERENCE TO RELATED APPLICATIONS

This application is based upon and claims the benefit of priority from the prior Japanese Patent Applications No 2012-189360, filed Aug. 30, 2012 and No. 2013-101828, filed May 14, 2013, the entire contents of which are incorporated herein by reference.

BACKGROUND OF THE INVENTION

1. Field of the Invention

The present invention relates to a pointer for use in a timepiece such as a wristwatch or a measuring instrument such as a meter, and a method of manufacturing the pointer.

2. Description of the Related Art

For example, a pointer for a wristwatch has been known as described in Japanese Utility-Model Application Laid-Open (Kokai) Publication No. Showa 62-195790 in which a pointer body is formed by using a carbon fiber sheet having front and back surfaces coated with a coating film made of synthetic resin.

However, this pointer is structured merely by using a carbon fiber sheet. Therefore, although the weight of the whole pointer can be reduced, the strength of the pointer body cannot be sufficiently ensured because the pointer body is formed by coating the front and back surfaces of the carbon fiber sheet with a coating film made of synthetic resin.

The present invention provides a pointer and a pointer manufacturing method capable of reducing the weight of the whole pointer and sufficiently ensuring the strength of the pointer body.

SUMMARY OF THE INVENTION

In accordance with one aspect of the present invention, there is provided a pointer comprising: a pointer body made of a material sheet formed by a plurality of fiber sheets having carbon fibers arranged in one direction being laminated together with arrangement directions of the carbon fibers being varied.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 3A and FIG. 3B depict the main portion of the pointer depicted in FIG. 2, of which FIG. 3A is an enlarged semi-sectional view of the main portion with a mount piece mounted on a pointer body, and FIG. 3B is an enlarged semi-sectional view of the main portion with the mount piece in the course of being mounted on the pointer body;

FIG. 4A and FIG. 4B each depicts a material sheet for the pointer body depicted in FIG. 1, of which FIG. 4A is an enlarged perspective view of the material sheet and FIG. 4B is an enlarged perspective view of the material sheet in a separated state;

FIG. 6A and FIG. 6B each depicts a second embodiment in which the present invention has been applied a pointer of a wristwatch, of which FIG. 6A is an enlarged front view of the pointer, and FIG. 6B is a partially-omitted, enlarged sectional view thereof taken along line B-B;

FIG. 7A and FIG. 7B each depicts a material sheet for the pointer body depicted in FIG. 6A and FIG. 6B, of which FIG. 7A is an enlarged perspective view of the material, sheet and FIG. 7B is an enlarged perspective view of the material sheet in a separated state;

FIG. 8A and FIG. 8B each depicts a third embodiment in which the present invention has been applied a pointer of a wristwatch, of which FIG. 8A is an enlarged front view of the pointer and FIG. 8B is a partially omitted, enlarged sectional view thereof taken along line C-C; and FIG. 9A and FIG. 9B each depicts a material sheet for the pointer body depicted in FIG. 8A and FIG. 8B, of which FIG. 9A is an enlarged perspective view of the material sheet and FIG. 9B is an enlarged perspective view of the material sheet in a separated state.

DETAILED DESCRIPTION OF THE PREFERRED EMBODIMENTS

First Embodiment

A first embodiment in which the present invention has been applied to a pointer of a wristwatch is described below with reference to FIG. 1 to FIG. 5.

A pointer 1 includes a pointer body 2, as depicted in FIG. 1 to FIG. 3A and FIG. 3B. The pointer body 2, which is formed in an elongated plate shape, has an arrow mark section 2*a* formed on one end thereof (in FIG. 1, the right end), and a narrow-width section 2*b* is formed to be elongated from the arrow mark section 2*a* toward the other end (in FIG. 1, toward the left end). From the elongated narrow-width section 2*b* toward the other end, a wide-width section 2*c* is formed. At a portion of the wide-width section 2*c* on a narrow-width section 2*b* side, a mount hole 2*d* is formed so as to vertically penetrate through that portion.

The pointer 1 also includes a mount piece 4 for mounting the pointer body 2 on a pointer shaft 3, as depicted in FIG. 1 to FIG. 3A and FIG. 3B. The mount piece 4 has a cylindrical section 4*a* inserted into the mount hole 2*d* of the pointer body 2 to fit into the pointer shaft 3, a presser section 4*b* provided on the upper end of the cylindrical section 4*a* to press the upper surface of the pointer body 2, a washer section 4*c* inserted in the lower end of the cylindrical section 4*a* to be placed on the lower surface of the pointer body 2, and a swaged section 4*d* provided at the lower end of the cylindrical section 4*a* to press the washer section 4*c* against the lower surface of the pointer body 2.

Figure 3A:
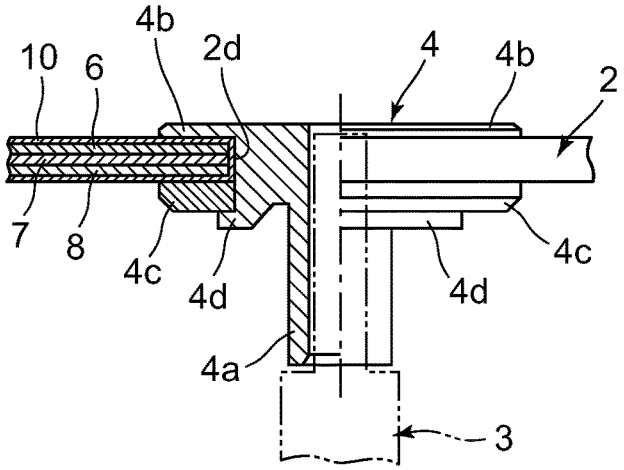
Figure 3B:
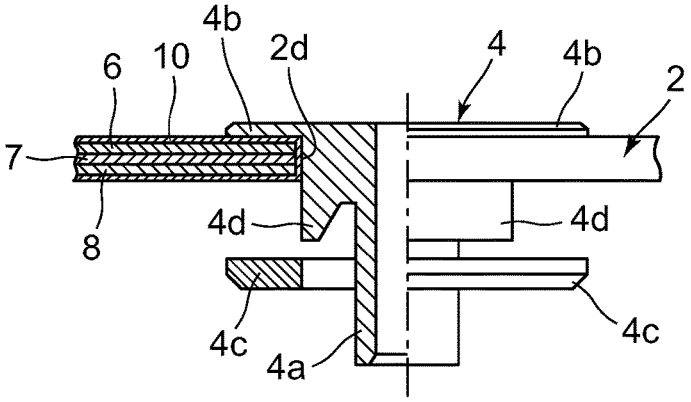

In this case, as depicted in FIG. 3A, the swaged section 4*d* is structured to push up the lower surface of the washer section 4*c* when swaged. Also, as depicted in FIG. 3B, the swaged section 4*d* is structured to droop downward in the mount hole 2*d* of the pointer body 2 before swaging. In the mounting of the mount piece 4 onto the pointer body 2, when the cylindrical section 4*a* of the mount piece 4 is inserted from above into the mount hole 2*d* of the pointer body 2, the section to be swaged 4*d* passes through the mount hole 2*d* of the pointer body 2 and projects to the lower side of the pointer body 2.

When the cylindrical section 4*a* of the mount piece 4 is inserted from above into the mount hole 2*d* of the pointer body and the section to be swaged 4*d* projects to the lower side of the pointer body 2, the washer section 4*c* is attached to the lower portion of the projecting cylindrical section 4*a* from below, as depicted in FIG. 3B. Then, in this state, when swaging processing is performed, the washer section 4*c* is pressed against the lower surface of the pointer body 2, as depicted in FIG. 3A.

As a result, the pointer 1 is structured as depicted in FIG. 1 to FIG. 3A and FIG. 3B such that, in a state where the cylindrical section 4*a* of the mount piece 4 has been inserted into the mount hole 2*d* of the pointer body 2 to cause the presser section 4*b* to abut on the upper surface of the pointer body 2, when swaging processing for the section to be swaged 4*d* is performed to cause the washer section 4*c* to push up the lower surface of the pointer body 2, the pointer body 2 is pinched between the washer section 4*c* and the presser section 4*b* in the thickness direction to mount the mount piece 4 on the pointer body 2.

The pointer 1 is structured to be mounted at the upper end of the pointer shaft 3 by fitting the cylindrical section 4*a* of the mount piece 4 in the upper end of the pointer shaft 3 when the mount piece 4 is mounted on the pointer body 2, as depicted in FIG. 1 to FIG. 3A and FIG. 3B. In this state, when the pointer shaft 3 is rotated by a timepiece movement (not shown), the pointer 1 moves according to the rotation of the pointer shaft 3 and thereby indicates time.

Figure 1:
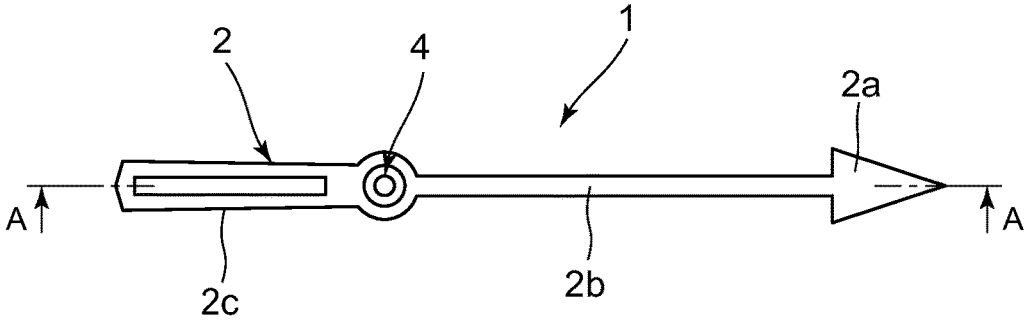
FIG. 1 is an enlarged front view of a first embodiment in which the present invention has been applied to a pointer of a wristwatch.
Figure 2:
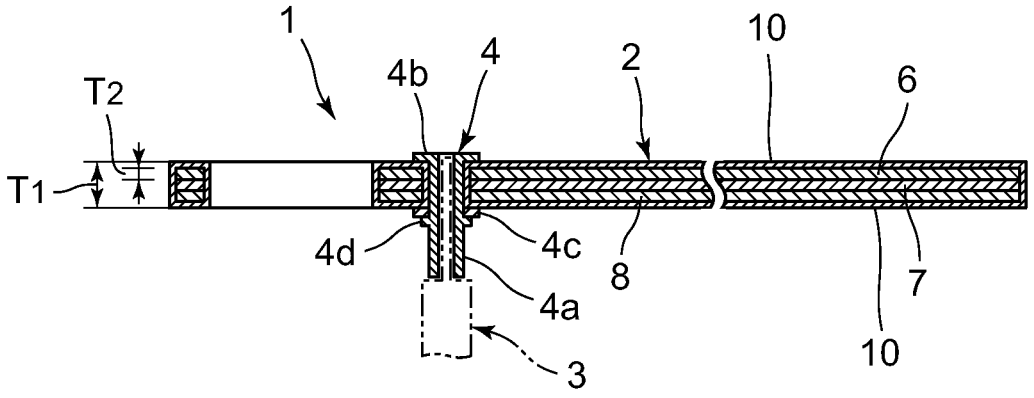
FIG. 2 is a partially-omitted, enlarged sectional view of the pointer taken along line A-A in FIG. 1.
Figure 4A:
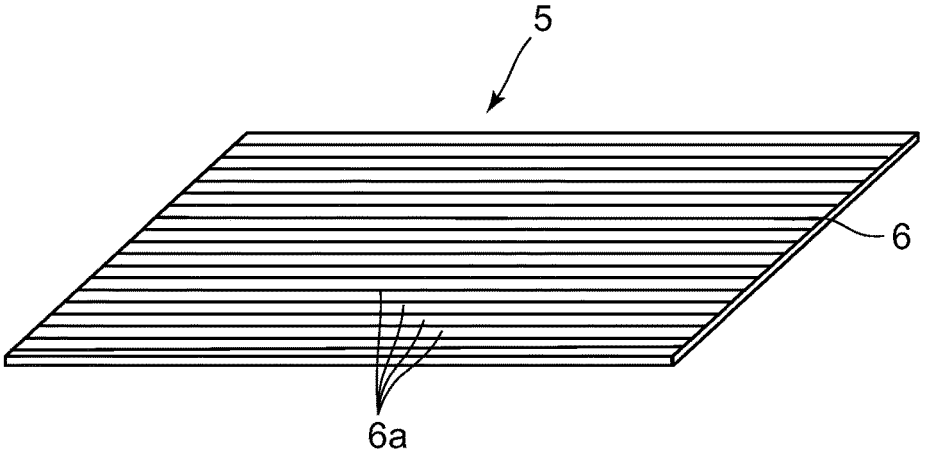
Figure 4B:
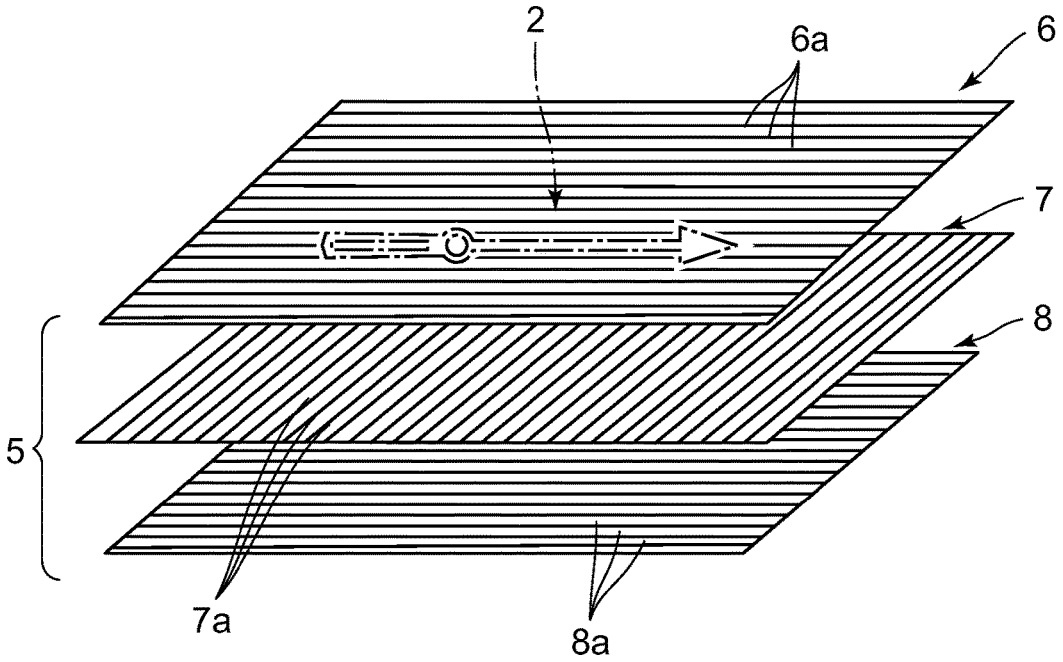
Figure 5:
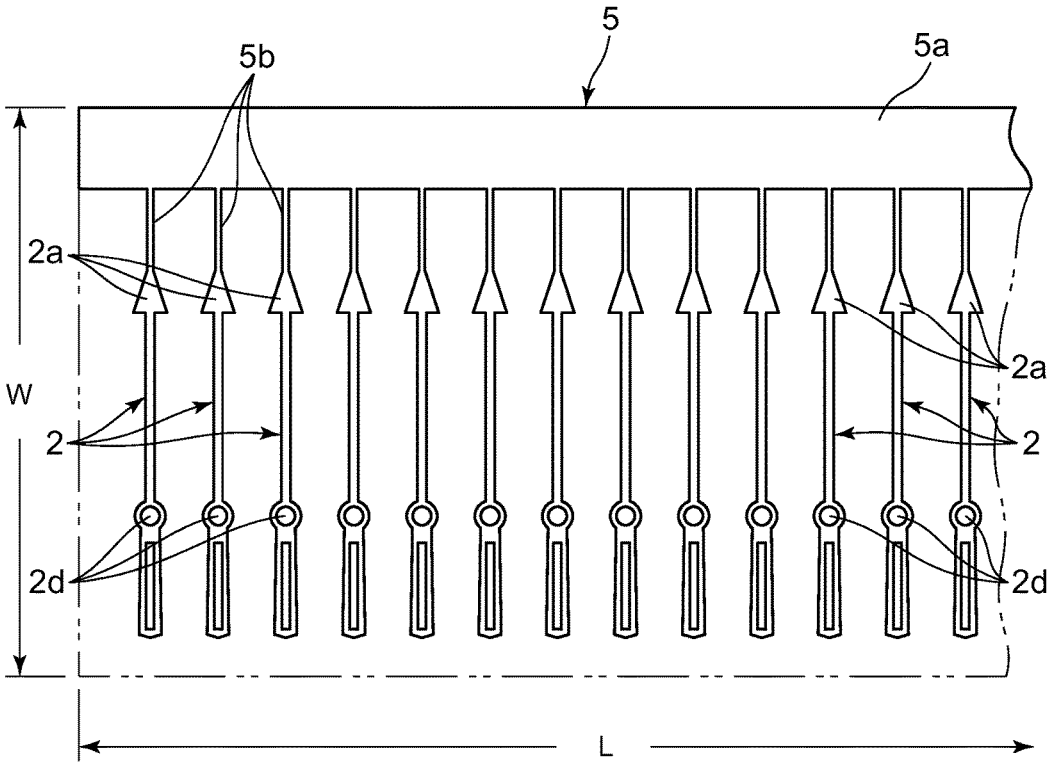
FIG. 5 is an enlarged front view of a state where a plurality of pointer bodies each depicted in FIG. 1 are formed to be arranged on the material sheet in parallel.

The pointer body 2 of the pointer 1 is formed of a material sheet 5, as depicted in FIG. 4A, FIG. 4B, and FIG. 5. In the material sheet 5, a plurality of (three in the first embodiment) fiber sheets 6 to 8 having carbon fibers 6*a* to 8*a* arranged in one direction are laminated together with the arrangement directions of the carbon fibers 6*a* to 3*a* being varied, as depicted in FIG. 4B. The material sheet 5 is formed to have a thickness T1 of approximately 0.1 mm as a whole, as depicted in FIG. 2.

That is, the first to third fiber sheets 6 to 8 are UD prepreg (Uni-Directional Prepreg) sheets with carbon fibers (6*a* to 8*a*) arranged in one direction and impregnated with synthetic resin. The fiber sheets 6 to 8 each has a thickness T2 of approximately 0.03 mm, as depicted in FIG. 2.

In this case, the UD prepreg sheets are sheet made of carbon fiber reinforced plastics. Examples of the carbon fibers (6*a* to 8*a*) are PAN (polyacrylonitrile)-based fiber carbons or pitch-based carbon fibers using pitch.

Also, the material sheet 5 has a three-layer structure where the first to third fiber sheets 6 to 8 have been laminated together, as depicted in FIG. 4B. In the material sheet 5, the first fiber sheet 6 serving as an upper layer and the third fiber sheet 8 serving as a lower layer have the respective carbon fibers 6*a* and 8*a* arranged in the same arrangement direction. Also, the second fiber sheet 7 serving as an intermediate layer has the carbon fibers 7*a* arranged in a direction orthogonal to the arrangement direction of the carbon fibers 6*a* and 8*a* of the first fiber sheet 6 serving as the upper layer and the third fiber sheet 8 serving as the lower layer.

In this case, as depicted in FIG. 4B, the first fiber sheet 6 serving as the upper layer and the third fiber sheet 8 serving as the lower layer have the respective carbon fibers 6*a* and 8*a* arranged in a direction parallel to the longitudinal direction of the pointer body 2. The second fiber sheet 7 serving as the intermediate layer has the carbon fibers 7*a* arranged in a direction orthogonal to the longitudinal direction of the pointer body 2.

As a result as depicted in FIG. 4B, the material sheet 5 is formed such that, when the first to third fiber sheets 6 to 8 are vertically divided into two in the laminating direction, the arrangement state of the carbon fibers 6*a* and 7*a* on the upper layer portion side (the first and second fiber sheets 6 and 7) and the arrangement state of the carbon fibers 7*a* and 8*a* on the lower layer portion side (the second and third fiber sheets 7 and 8) are identical to each other.

Also, as depicted in FIG. 2, the material sheet 5 is formed such that the first to third fiber sheets 6 to 8 laminated together are vertically bonded together by thermocompression bonding and the thickness T1 in the vertical direction is approximately 0.1 mm. Furthermore, the pointer body 2 formed of the material sheet 5 has its entire surface coated with a coating film 10, as depicted in FIG. 2, FIG. 3A, and FIG. 3B. The coating film 10 is a film made of synthetic resin, and is structured to cover the entire surface including the front surface, the back surface, and each peripheral side surface of the pointer body 2 for protection.

Next, a method of manufacturing the pointer body 2 of the pointer 1 is described.

First, in the manufacture of the material sheet 5, the carbon fibers 6*a* to 8*a* are each arranged in one direction and impregnated with synthetic resin, whereby the first to third fiber sheets 6 to 8 are each formed. Then, the first to third fiber sheets 6 to 8 are laminated together with the arrangement directions of the carbon fibers 6*a* to 8*a* being varied, and bonded together by thermocompression bonding.

In this case, the first fiber sheet 6 serving as the upper layer and the third fiber sheet 8 serving as the lower layer have the respective carbon fibers 6*a* and 8*a* arranged in a direction parallel to the longitudinal direction of the pointer body 2. The second fiber sheet 7 serving as the intermediate layer has the carbon fibers 7*a* arranged in a direction orthogonal to the longitudinal direction of the pointer body 2. In this state, the first to third fiber sheets 6 to 8 are laminated together and bonded together by thermocompression bonding, whereby the material sheet 5 having the thickness T1 of approximately 0.1 mm as a whole is formed.

Also, as depicted in FIG. 5, the material sheet 5 has a short side W (in FIG. 5, a length in the vertical direction) slightly longer than the length of the pointer body 2 in the longitudinal direction and a long side L (in FIG. 5, a length in the horizontal direction) in a direction orthogonal to the short side W, and the long side L is formed to have a band shape sufficiently longer than the short side W. As a result, the material sheet 5 is formed such that a number of pointer bodies 2 are arranged in parallel to each other along the long side L in the longitudinal direction.

In this case, in the material sheet 5, the carbon fibers 6*a* and 8*a* in the first fiber sheet 6 serving as the upper layer and the third fiber sheet 8 serving as the lower layer are arranged in a direction along the short side W, that is, along the longitudinal direction of the pointer body 2, and the carbon fibers 7*a* in the second fiber sheet 7 serving as the intermediate layer are arranged in a direction along the long side L, that is, along a direction orthogonal to the longitudinal direction of the pointer body 2, as depicted in FIG. 5.

Then, as depicted in FIG. 5, the material sheet 5 is cut with a laser beam to sequentially form the pointer bodies 2. Here, the material sheet 5 is sequentially cut with a laser beam along the outer shape of each pointer body 2 so that many pointer bodies 2 are arranged in parallel to each other along the longitudinal direction (in FIG. 5, the horizontal direction) of the band-shaped material sheet 5.

In this case, the pointer body 2 is cut out except for the tip of the arrow mark section 2*a* and thereby is formed with the tip of the arrow mark section 2*a* being coupled to a coupling section 5*b* of the material sheet 5 with an elongated connecting section 5*a*. That is, in the material sheet 5, many pointer bodies 2 sequentially coupled to the coupling sections 5*b* of the material sheet 5 with the connecting section 5*a* are formed to be arranged in parallel to each other each in a strap shape, as depicted in FIG. 5.

Then, the coating film 10 is formed on the entire surface of the pointer bodies 2. Here, the pointer bodies 2 each connected to the coupling section 5*h* of the material sheet 5 are immersed in a coating fluid all at once, whereby the entire surface of the pointer bodies 2 is coated with the coating fluid. When the coated coating fluid is dried, the coating film 10 is formed on the entire surface of the pointer bodies 2.

Thereafter, the pointer bodies 2 where the coating film 10 has been formed are separated from the coupling sections 5*b* of the material sheet 5. Here, the tip of the arrow mark section 2*a* at one end of each pointer body 2 is cut with a laser beam to be separated from the connecting section 5*a*. As a result, the pointer bodies 2 are individually separated from each other. Only a cut portion of each separated pointer body 2 is again immersed in the coating fluid, whereby the coating film 10 is additionally formed only on the cut portion.

In the pointer body 2 formed as described above, the first fiber sheet 6 serving as the upper layer and the third fiber sheet 3 serving as the lower layer have the respective carbon fibers 6*a* and 8*a* arranged in a direction parallel to the longitudinal direction of the pointer body 2, as depicted in FIG. 4B. Accordingly, the flexural strength of the pointer body 2 is strong, and deformation such as warpage or twist of the pointer body 2 is suppressed. As a result, warped deformation of the pointer body 2 in the longitudinal direction is suppressed.

As depicted in FIG. 4B, in the pointer body 2, the second fiber sheet 7 serving as the intermediate layer has the carbon fibers 7*a* arranged in a direction orthogonal to the longitudinal direction of the pointer body 2, whereby the strength against deformations such as warpage and twist of the pointer body 2 is strong, strength against various types of deformation such as warpage, sag, or twist is high, and the impact resistance is also enhanced.

Next, mounting of the mount piece 4 onto the pointer body 2 and mounting of the pointer body 2 onto the pointer shaft 3 with the mount piece 4 are described.

First, as depicted in FIG. 3B, the cylindrical section 4*a* of the mount piece 4 is inserted from above into the mount hole 2*d* of the pointer body 2, whereby the presser section 4*b* abuts on the upper surface of the pointer body 2, and the section to be swaged 4*d* projects to the lower side of the pointer body 2. In this state, the washer section 4*c* is attached to the lower portion of the projecting cylindrical section 4*a* from below, and swaging processing for the section to be swaged 4*d* is performed.

As a result, the washer section 4*c* is pushed onto the lower surface of the pointer body 2 by the swaged section 4*d* subjected to the swaging processing, as depicted in FIG. 3A. Accordingly, with the swaged section 4*d* pushing the washer section 4*c* to the lower surface of the pointer body 2, the pointer body 2 is pinched between the washer section 4*c* and the presser section 4*b* in the thickness T1 direction, as depicted in FIG. 3A. As a result the mount piece 4 is mounted on the pointer body 2 to configure the pointer 1.

Then, in the mounting of the pointer body 2 onto the pointer shaft 3, when the cylindrical section 4*a* of the mount piece 4 of the pointer 1 is fitted into the upper end of the pointer shaft 3, the pointer body 2 is mounted on the upper end of the pointer shaft 3 with the mount piece 4, as depicted in FIG. 2 and FIG. 3A. In this state, when the pointer shaft 3 is rotated by a timepiece movement (not shown), the pointer 1 moves according to the rotation of the pointer shaft 3 and thereby indicates time.

As such, the plurality of fiber sheets 6 to 8 having the carbon fibers 6*a* to 8*a* arranged in one direction are laminated together with the arrangement directions of the carbon fibers 6*a* to 8*a* being varied. As a result, the material sheet 5 is formed, and the pointer body 2 is formed thereby. Therefore, with this pointer 1, the weight of the pointer body 2 can be reduced, and the strength of the pointer body 2 can be sufficiently ensured.

That is, in the case of this pointer 1, when the first to third fiber sheets 6 to 8 having the carbon fibers 6*a* to 8*a* arranged in one direction are to be laminated together to form the material sheet 5, the arrangement directions of the carbon fibers 6*a* to 8*a* can be varied. Therefore, compared with the case where the pointer body 2 is structured of one fiber sheet, the strength of the pointer body 2 can be sufficiently enhanced, and the impact resistance can also be enhanced.

Also, in the case of this pointer 1, the first to third fiber sheets 6 to 8 are formed with the carbon fibers 6*a* to 8*a* being arranged in one direction, whereby the thickness T2 of each of the first to third fiber sheets 6 to 8 can be thinned, As a result, the thickness and weight of the whole pointer body 2 can be reduced. Accordingly, power consumption when the pointer body 2 is moved can be reduced, which extends the life of the battery. In addition, the size of the pointer body 2 can be increased, and the shape of the pointer body 2 can be freely formed.

In this case, in the material sheet 5, when the first to third fiber sheets 6 to 8 are vertically divided into two in the laminating direction, the arrangement state of the carbon fibers 6*a* and 7*a* positioned on the upper layer portion side and the arrangement state of the carbon fibers 7*a* and 8*a* positioned on the lower layer portion side are identical to each other. Therefore, even when the first to third fiber sheets 6 to 8 are laminated together to form the pointer body 2 with the arrangement directions of the carbon fibers 6*a* to 8*a* being varied, deformation such as warpage, sag, or twist of the pointer body 2 can be suppressed, whereby the pointer bodies 2 can be kept to have a uniform shape.

That is, in the material sheet 5, even if the arrangement directions of the first to third carbon fibers 6*a* to 8*a* are varied when the first to third fiber sheets 6 to 8 are laminated together to form the pointer body 2, the arrangement state of the carbon fibers 6*a* and 7*a* of the first and second fiber sheets 6 and 7 positioned on the upper layer portion side obtained by division into two in the laminating direction and the arrangement state of the carbon fibers 7*a* and 8*a* of the second and third fiber sheets 7 and 8 positioned on the lower layer portion side are identical to each other, whereby an imbalance in strength between the upper layer portion and the lower layer portion due to the varied arrangement directions of the carbon fibers 6*a* to 8*a* can be cancelled out. As a result, deformation such as warpage, sag, or twist of the pointer body 2 due to the varied arrangement directions of the carbon fibers 6*a* to 8*a* can be reliably suppressed.

Also, the material sheet 5 is formed by laminating the first to third fiber sheets 6 to 8 together in three layers. The first fiber sheet 6 serving as the upper layer and the third fiber sheet 8 serving as the lower layer have the respective carbon fibers 6*a* and 8*a* arranged in the same arrangement direction. The second fiber sheet 7 serving as the intermediate layer has the carbon fibers 7*a* arranged in a direction orthogonal to the arrangement direction of the carbon fibers 6*a* and 8*a* of the first fiber sheet 6 and the third fiber sheet 8. Therefore, the arrangement state on the upper layer portion side of the carbon fibers 6*a* to 8*a* and the arrangement state on the lower layer portion side thereof can be made identical to each other. As a result the strength of the pointer body 2 can be enhanced, and deformation such as warpage, sag, or twist of the pointer body 2 can be suppressed.

In this case, the first fiber sheet 6 serving as the upper layer and the third fiber sheet 8 serving as the lower layer have the respective carbon fibers 6*a* and 8*a* arranged in a direction parallel to the longitudinal direction of the pointer body 2. As a result, the strength of the pointer body 2 in the longitudinal direction can be enhanced and whereby warped deformation of the pointer body 2 in the longitudinal direction can be reliably and favorably suppressed.

Moreover, the second fiber sheet 7 serving as the intermediate layer has the carbon fibers 7*a* arranged in a direction orthogonal to the longitudinal direction of the pointer body 2, whereby the strength of the pointer body 2 in the twisting direction can be enhanced. As a result, deformation in the twisting direction of the pointer body 2 can be suppressed. Accordingly, in the pointer 1, strength against various types of deformation such as warpage, sag, or twist of the pointer body 2 can be sufficiently enhanced.

Furthermore, in the pointer 1, the pointer body 2 is coated with the coating film 10, whereby the entire surface of the pointer body 2 can be protected with the coating film 10. In this case, when the material sheet 5 in which the first to third fiber sheets 6 to 8 have been laminated together is cut to form the pointer body 2, the coating film 10 can reliably prevent the end face of each of the cut carbon fibers 6*a* to 8*a* from falling from the perimeter of the pointer body 2 as fine fragments, whereby the pointer body 2 can be favorably protected.

Still further, the pointer 1 includes the mount piece 4 for mounting the pointer body 2 on the pointer shaft 3. The mount piece 4 has the cylindrical section 4*a* inserted into the mount hole 2*d* of the pointer body 2 to fit into the pointer shaft 3, the presser section 4*b* provided on the upper end of the cylindrical section 4*a* to press the upper surface of the pointer body 2, the washer section 4*c* inserted in the lower end of the cylindrical section 4*a* so as to be placed on the lower surface of the pointer body 2, and the swaged section 4*d* provided at the lower end of the cylindrical section 4*a* to press the washer section 4*c* against the lower surface of the pointer body 2. Thus, the pointer body 2 can be reliably and favorably mounted on the pointer shaft 3 with the mount piece 4.

In this case, the swaged section 4*d* is structured to droop downward in the mount hole 2*d* of the pointer body 2 before swaging. Therefore, in the mounting of the mount piece 4 onto the pointer body 2, when the cylindrical section 4*a* of the mount piece 4 is inserted from above into the mount hole 2*d* of the pointer body 2, the section be swaged 4*d* can pass through the mount hole 2*d* of the pointer body 2 to project to the lower side of the pointer body 2.

When the cylindrical section 4*a* of the mount piece 4 is inserted from above into the mount hole 2*d* of the pointer body 2 to project to the lower side of the pointer body 2, the washer section 4*c* is attached to the lower portion of the projecting cylindrical section 4*a* from below, and swaging processing for the section to be swaged 4*d* is performed in this state. As a result of this structure, when swaging processing for the section to be swaged 4*d* is performed, the washer section 4*c* can be reliably and favorably pressed against the lower surface of the pointer body 2 by the swaged section 4*d*.

Accordingly, in the pointer 1, in a state where the cylindrical section 4*a* of the mount piece 4 has been inserted into the mount hole 2*d* of the pointer body 2 to cause the presser section 4*b* to abut on the upper surface of the pointer body 2, when swaging processing for the section to be swaged 4*d* is performed and the washer section 4*c* pushes up the lower surface of the pointer body 2, the pointer body 2 can be pinched between the washer section 4*c* and the presser section 4*b* in the thickness direction. As a result, the mount piece 4 can be reliably mounted on the pointer body 2 without damaging the pointer body 2, and the pointer body 2 can be favorably mounted on the pointer shaft 3 by the mount piece 4.

The method of manufacturing the pointer 1 includes a first step of forming the material sheet 5 by laminating the first to third fiber sheets 6 to 8 having the carbon fibers 6*a* to 8*a* arranged thereon, with the arrangement directions of the carbon fibers 6*a* to 8*a* being varied, and a second step of forming the pointer body 2 by cutting the material sheet 5 with a laser beam. As a result, even if the first to third fiber sheets 6 to 8 are laminated together to form the material sheet 5 with the arrangement directions of the carbon fibers 6*a* to 8*a* being varied, the pointer body 2 can be cut and formed into an accurate shape by cutting the material sheet 5 with a laser beam.

In this case, in the first step, the material sheet 5 is formed in a band shape having the short side W slightly longer than the length of the pointer body 2 in the longitudinal direction and the long side L having a length in which a number of pointer bodies 2 are arranged in parallel to each other, whereby a number of pointer bodies 2 can be formed to be successively arranged in parallel along the longitudinal direction of the material sheet 5.

Also, in the second step, in cutting of the band-shaped material sheet 5 along the outer shape of the pointer body 2 with a laser beam, continuous cutting is performed except for one end of the pointer body 2 in the longitudinal direction, that is, the tip of the arrow mark section 2*a*. As a result, a number of pointer bodies 2 can be formed on the material sheet 5 with being coupled together.

Accordingly, in the formation of the coating film 10 on the pointer body 2, a number of pointer bodies 2 are immersed in the coating fluid all at once to form the coating film 10 on the entire surface of the pointer bodies 2. Therefore, the productivity can be increased, mass production can be made, and the production cost can be decreased.

Second Embodiment

Next, a second embodiment in which the present invention has been applied to a pointer 15 of a wristwatch is described with reference to FIG. 6A, FIG. 6B, FIG. 7A, and FIG. 7B. Note that sections that are identical to those of the first embodiment depicted in FIG. 1 to FIG. 5 are given the same reference numerals for description.

The pointer 15 is structured such that first to fourth fiber sheets 16 to 19 having carbon fibers 16*a* to 19*a* arranged in one direction are laminated together with the arrangement directions of the carbon fibers 16*a* to 19*a* being varied, and a material sheet 20 is formed thereby. Except for this point, the second embodiment is identical in structure to the first embodiment.

That is, as with the first embodiment, the first to fourth fiber sheets 16 to 19 are UP prepreg sheets (carbon fiber reinforced synthetic resin sheets) acquired by the carbon fibers 16*a* to 19*a* being arranged in one direction and impregnated with synthetic resin. The fiber sheets 16 to 19 are each formed to have the thickness T2 of approximately 0.03 mm. As depicted in FIG. 7E, the material sheet 20 has a four-layer structure where the first to fourth fiber sheets 16 to 19 have been laminated together.

Figure 7A:
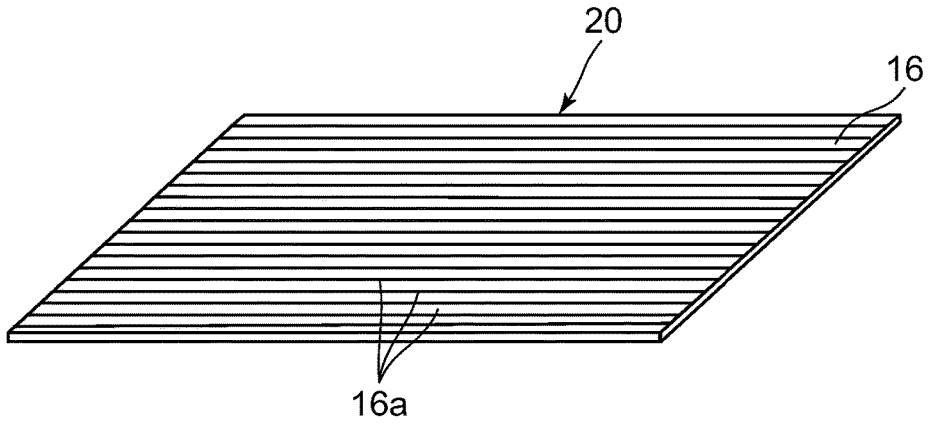
Figure 7B:
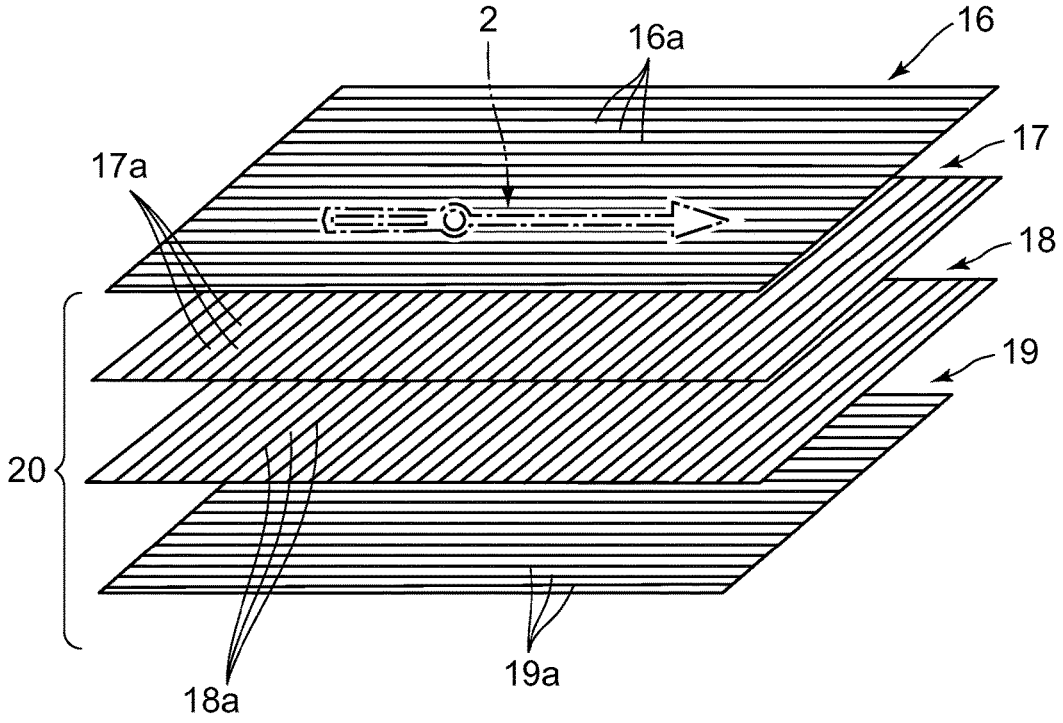

In the material sheet 20, the first fiber sheet 16 serving as the uppermost layer and the fourth fiber sheet 19 serving as the lowermost layer have the respective carbon fibers 16*a* and 19*a* arranged in the same arrangement direction, as depicted in FIG. 7B. Also, the second fiber sheet 17 and the third fiber sheet 18, which are two layers positioned in the middle, have the respective carbon fibers 17*a* and 18*a* arranged in a direction orthogonal to the arrangement direction of the carbon fibers 16*a* and 19*a* of the first fiber sheet 16 and the fourth fiber sheet 19.

In this case, as depicted in FIG. 7B, the first fiber sheet 16 serving as the uppermost layer and the fourth fiber sheet 19 serving as the lowermost layer have the respective carbon fibers 16*a* and 19*a* arranged in a direction parallel to the longitudinal direction of the pointer body 2. Also, the second fiber sheet 17 and the third fiber sheet 18, which are two layers positioned in the middle, have the respective carbon fibers 17*a* and 18*a* arranged in a direction orthogonal to the longitudinal direction of the pointer body 2.

As a result, as depicted in FIG. 7B, the material sheet 20 is formed such that, when the first to fourth fiber sheets 16 to 19 are vertically divided into two in the laminating direction, the arrangement state of the carbon fibers 16*a* and 17*a* in the first fiber sheet 16 and the second fiber sheet 17 positioned on the upper layer portion side and the arrangement state of the carbon fibers 18*a* and 19*a* in the third fiber sheet 18 and the fourth fiber sheet 19 positioned on the lower layer portion side are identical to each other.

Figure 6A:
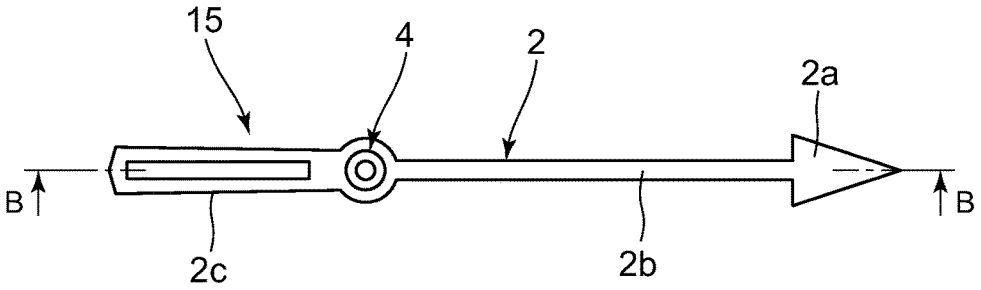
Figure 6B:
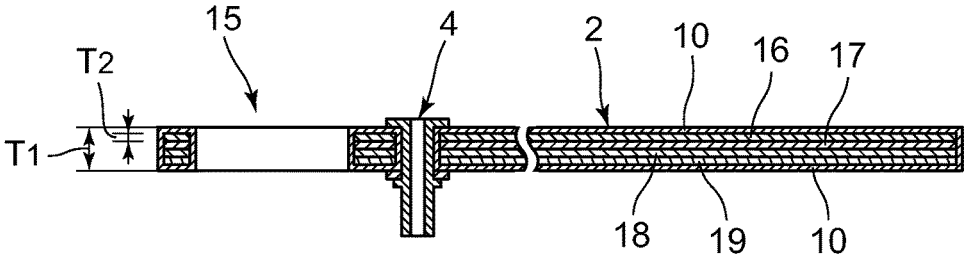

Also, as depicted in FIG. 6A and FIG. 6B, the material sheet 20 is formed such that the first to fourth fiber sheets 16 to 19 laminated together are vertically bonded together by thermocompression bonding and the thickness T1 in the vertical direction is approximately 0.12 TEM to 0.13 mm. In addition, as with the first embodiment, the pointer body 2 formed of the material sheet 20 has its entire surface coated with the coating film 10.

As in the case of the first embodiment, the method of manufacturing the pointer body 2 with the material sheet 20 includes a first step of forming the material sheet 20 by laminating the first to fourth fiber sheets 16 to 19 having the carbon fibers 16*a* to 19*a* arranged in one direction, with the arrangement directions of the carbon fibers 16*a* to 19*a* being varied, and a second step of forming the pointer body 2 by cutting the material sheet 20 with a laser beam.

In this case as well, in the first step, the material sheet 20 is formed in a band shape having the short side W slightly longer than the length of the pointer body 2 in the longitudinal direction and the long side L having a length in which a number of pointer bodies 2 are arranged in parallel to each other, as with the first embodiment. Also, in the second step, the band-shaped material sheet 20 is continuously cut with a laser beam except for one end of the pointer body 2 in the longitudinal direction, that is, the tip of the arrow mark section 2*a*, whereby a number of pointer bodies 2 are formed on the material sheet 20 with being coupled together, as in the case of the first embodiment.

As such, in the case of the pointer 15, the fiber sheets 16 to 19 having the carbon fibers 16*a* to 19*a* arranged in one direction are laminated together with the arrangement directions of the carbon fibers 16*a* to 19*a* being varied. As a result, the material sheet 20 is formed, and the pointer body 2 is formed thereby. Thus, as with the first embodiment, the weight of the pointer body 2 can be reduced, and the strength of the pointer body 2 can be sufficiently ensured.

That is, in the case of the pointer 15, when the first to fourth fiber sheets 16 to 19 having the carbon fibers 16*a* to 19*a* arranged in one direction are to be laminated together to form the material sheet 20, the arrangement directions of the carbon fibers 16*a* to 19*a* can be varied. Therefore, compared with the case where the pointer body 2 is structured of one fiber sheet, the strength of the pointer body 2 can be sufficiently enhanced, and the impact resistance can also be enhanced, as in the case of the first embodiment.

Also, in the case of the pointer 15, the first to fourth fiber sheets 16 to 19 are formed with the carbon fibers 16*a* to 19*a* being arranged in one direction, whereby the thickness T2 of each of the first to fourth fiber sheets 16 to 19 can be thinned. As a result, as with the first embodiment, the thickness and weight of the whole pointer body 2 can be reduced. Accordingly, power consumption when the pointer body 2 is moved can be reduced, which extends the life of the battery, in addition, the size of the pointer body 2 can be increased, and the shape of the pointer body 2 can be freely formed.

In this case, in the material sheet 20, when the first to fourth fiber sheets 16 to 19 are vertically divided into two in the laminating direction, the arrangement state of the carbon fibers 16*a* and 17*a* of the first and second fiber sheets 16 and 17 positioned on the upper layer side and the arrangement state of the carbon fibers 18*a* and 19*a* of the third and fourth fiber sheets 18 and 19 positioned on the lower layer side are identical to each other. Therefore, even when the first to fourth fiber sheets 16 to 19 are laminated together to form the pointer body 2 with the arrangement directions of the carbon fibers 16*a* to 19*a* being varied, deformation such as warpage, sag, or twist of the pointer body 2 can be suppressed, whereby the pointer bodies 2 can be kept to have a uniform shape.

That is, in the material sheet 20, even if the arrangement directions of the first to fourth carbon fibers 16*a* to 19*a* are varied when the first to fourth fiber sheets 16 to 19 are laminated together to form the pointer body 2, the arrangement state of the carbon fibers 16*a* and 17*a* of the first and second fiber sheets 16 and 17 positioned on the upper layer portion side obtained by division into two in the laminating direction and the arrangement state of the carbon fibers 18*a* and 19*a* of the third and fourth fiber sheets 18 and 19 positioned on the lower layer portion side are identical to each other, whereby an imbalance in strength between the upper layer portion and the lower layer portion due to the varied arrangement directions of the carbon fibers 16*a* to 19*a* can be cancelled out. As a result, deformation such as warpage, sag, or twist of the pointer body 2 due to the varied arrangement directions of the carbon fibers 16*a* to 19*a* can be reliably suppressed.

Moreover, the material sheet 20 is formed by laminating the first to fourth fiber sheets 16 to 19 together in four layers. The first fiber sheet 16 serving as the uppermost layer and the fourth fiber sheet 19 serving as the lowermost layer have the respective carbon fibers 16*a* and 19*a* arranged in the same arrangement direction. The second fiber sheet 17 and the third fiber sheet 18 positioned in the middle have the carbon fibers 17*a* and 18*a* arranged in a direction orthogonal to the arrangement direction of the carbon fibers 16*a* and 19*a* in the first fiber sheet 16 serving as the uppermost layer and the fourth fiber sheet 19 serving as the lowermost layer. Therefore, the arrangement states of the carbon fibers 16*a* to 19*a* on the upper layer portion side and on the lower layer portion side thereof can be made identical to each other. As a result, the strength of the pointer body 2 can be enhanced, and deformation such as warpage, sag, or twist of the pointer body 2 can be suppressed.

In this case, the first fiber sheet 16 serving as the uppermost layer and the fourth fiber sheet 19 serving as the lowermost layer have the respective carbon fibers 16*a* and 19*a* arranged in a direction parallel to the longitudinal direction of the pointer body 2. As a result, the strength of the pointer body 2 in the longitudinal direction can be enhanced and whereby warped deformation of the pointer body 2 in the longitudinal direction can be reliably and favorably suppressed.

Furthermore, the second fiber sheet 17 and the third fiber sheet 18 serving as the intermediate layers have the respective carbon fibers 17*a* and 18*a* arranged in a direction orthogonal to the longitudinal direction of the pointer body 2, whereby the strength of the pointer body 2 in the twisting direction can be enhanced. As a result, deformation in the twisting direction of the pointer body 2 can be suppressed. Accordingly, in this pointer 15 as well, strength against various types of deformation of the pointer body 2, such as warpage, sag, or twist, can be sufficiently enhanced.

Still further, the pointer 15 has the pointer body 2 coated with the coating film 10, whereby the entire surface of the pointer body 2 can be protected with the coating film 10, as in the case of the first embodiment. In this case, when the material sheet 20 in which the first to fourth fiber sheets 16 to 19 have been laminated together is cut to form the pointer body 2, the coating film 10 can reliably prevent the end face of each of the cut carbon fibers 16*a* to 19*a* from falling from the perimeter of the pointer body 2 as fine fragments, whereby the pointer body 2 can be favorably protected.

Third Embodiment

Next, a third embodiment in which the present invention has been applied to a pointer 24 of a wristwatch is described with reference to FIG. 8A, FIG. 8E, FIG. 9A, and FIG. 9B. Note that sections that are identical to those of the first embodiment depicted in FIG. 1 to FIG. 5 are given the same reference numerals for description.

Figure 9A:
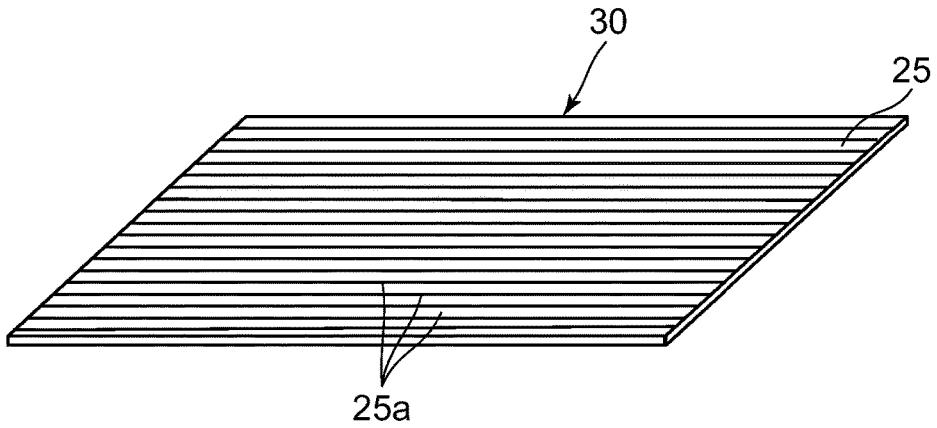
Figure 9B:
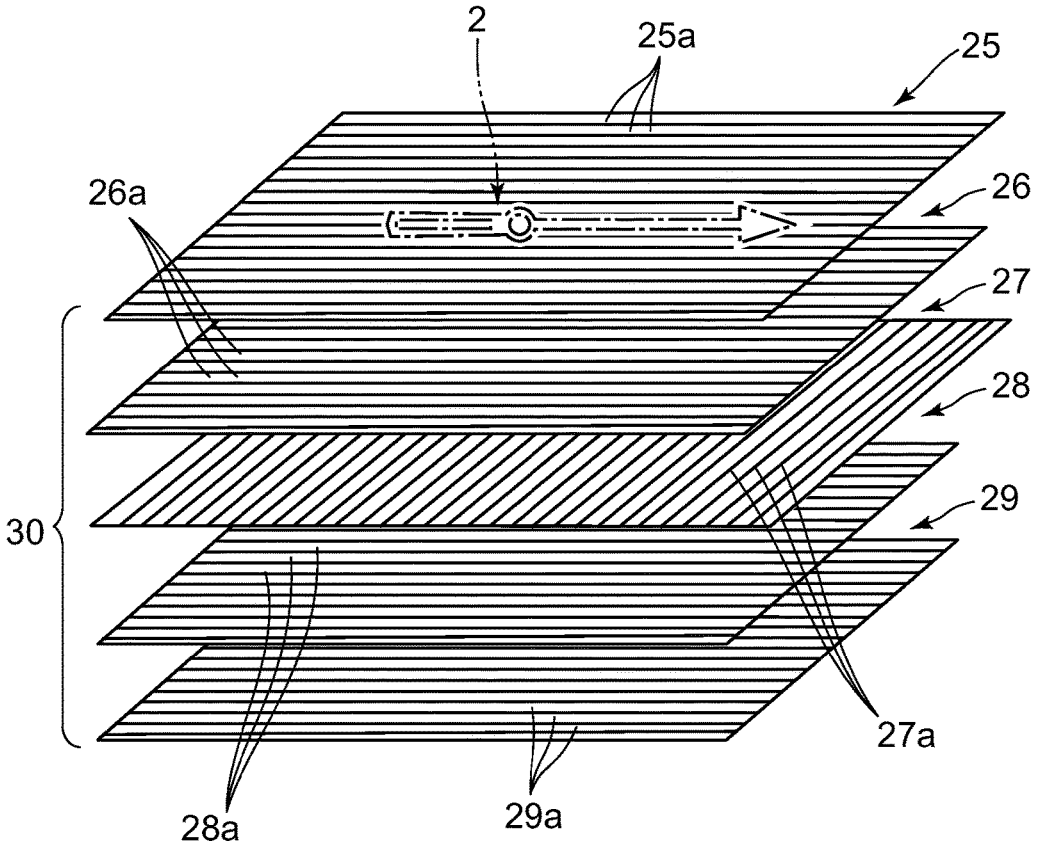

As depicted in FIG. 9A and FIG. 9B, the pointer 24 is structured such that first to fifth fiber sheets 25 to 29 having carbon fibers 25*a* to 29*a* arranged in one direction are laminated together with the arrangement directions of the carbon fibers 25*a* to 29*a* being varied, and a material sheet 30 is formed thereby. Except for this point, the third embodiment is approximately identical in structure to the first embodiment.

Figure 8A:
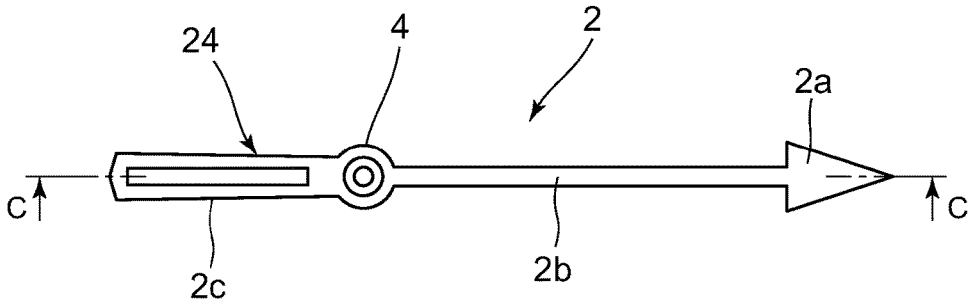
Figure 8B:
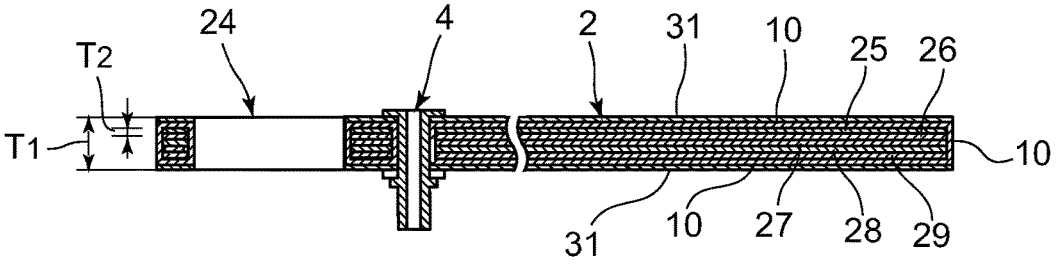

That is, as with the first embodiment, the first to fifth fiber sheets 25 to 29 are UD prepreg sheets (carbon fiber reinforced synthetic resin sheets) acquired by the carbon fibers 25*a* to 29*a* being arranged in one direction and impregnated with synthetic resin. The fiber sheets 25 to 29 are each formed to have the thickness T2 of approximately 0.03 mm. As depicted in FIG. 8B and FIG. 9B, the material sheet 30 has a five-layer structure where the first to fifth fiber sheets 25 to 29 have been laminated together.

In the material sheet 30, the first and second fiber sheets 25 and 26 on the upper layer side and the fourth and fifth fiber sheets 28 and 29 on the lower layer side have the respective carbon fibers 25*a*, 26*a*, 28*a*, and 29*a* arranged in the same arrangement direction, as depicted in FIG. 9B. Also, the third fiber sheet 27 positioned in the middle has the carbon fibers 27*a* arranged in a direction orthogonal to the arrangement directions of the carbon fibers 25*a*, 26*a*, 28*a*, and 29*a* of the first and second fiber sheets 25 and 26 and the fourth and fifth fiber sheets 28 and 29.

In this case, as depicted in FIG. 9B, the first and second fiber sheets 25 and 26 on the upper layer side and the fourth and fifth fiber sheet 28 and 29 on the lower layer side have the respective carbon fibers 25*a*, 26*a*, 28*a*, and 29*a* arranged in a direction parallel to the longitudinal direction of the pointer body 2. Also, the third fiber sheet 27 positioned in the middle has the carbon fibers 27*a* arranged in a direction orthogonal to the longitudinal direction of the pointer body 2.

As a result, as depicted in FIG. 9B, the material sheet 30 is formed such that, when the first to fifth fiber sheets 25 to 29 are vertically divided into two in the laminating direction, the arrangement state of the carbon fibers 25*a*, 26*a*, and 27*a* in the first and second fiber sheets 25 and 26 positioned on the upper layer side and the third fiber sheet 27 positioned in the middle and the arrangement state of the carbon fibers 27*a*, 28*a*, and 29*a* in the third fiber sheet 27 positioned in the middle and the fourth and fifth fiber sheet 28 and 29 positioned on the lower layer side are identical to each other.

Also, as depicted in FIG. 8B, the material sheet 30 is formed such that the first to fifth fiber sheets 25 to 29 laminated together are vertically bonded together by thermocompression bonding and the thickness T1 in the vertical direction is approximately 0.165 mm. In addition, as with the first embodiment, the pointer body 2 formed of the material sheet 30 has its entire surface coated with the coating film 10.

In this case, as depicted in FIG. 8B, the upper surface and the lower surface of the pointer body 2 are each provided with a print layer 31 by silk screen printing or pad printing. The print layer 31 on the upper surface of the pointer body 2 and that on the lower surface are colored with the same ink and have the same thickness so that the same ink shrinkage ratio is achieved between the upper surface and the lower surface of the pointer body 2. The color of the print layer 31 is desirably transparent. However, the color of the print layer 31 on the upper surface and the color thereof on the lower surface may be different so as to identify the upper surface and the lower surface of the pointer body 2.

As with the first embodiment, the method of manufacturing the pointer body 2 with the material sheet 30 includes a first step of forming the material sheet 30 by laminating the first to fifth fiber sheets 25 to 29 having the carbon fibers 25*a* to 29*a* arranged in one direction, and a second step of forming the pointer body 2 by cutting the material sheet 30 with a laser beam.

In the lamination of the first to fifth fiber sheets 25 to 29 in this first step, these fiber sheets are laminated with, among the carbon fibers 25*a* to 29*a*, the arrangement direction of the carbon fibers 27*a* of the third fiber sheet 27 positioned in the middle being varied with respect to the arrangement directions of the carbon fibers 25*a*, 26*a*, 28*a*, and 29*a* of the other fiber sheets 25, 26, 28, and 29.

Also, in the first step, the material sheet 30 is formed in a band shape having the short side slightly longer than the length of the pointer body 2 in the longitudinal direction and the long side L having a length in which a number of pointer bodies 2 are arranged in parallel to each other, as with the first embodiment. Also, in the second step, the band-shaped material sheet 30 is continuously cut with a laser beam except for one end of the pointer body 2 in the longitudinal direction, that is, the tip of the arrow mark section 2*a*, whereby a number of pointer bodies 2 are formed on the material sheet 30 with being coupled together, as in the case of the first embodiment.

As such, in the case of the pointer 24, the first to fifth fiber sheets 25 to 29 having the carbon fibers 25*a* to 29*a* arranged in one direction are laminated together with the arrangement direction of the carbon fibers 27*a* of the third fiber sheet 27 positioned in the middle among the carbon fibers 25*a* to 29*a* being varied. As a result, the material sheet 30 is formed, and the pointer body 2 is formed thereby. Thus, as with the first embodiment, the weight of the pointer body 2 can be reduced, and the strength of the pointer body 2 can be sufficiently ensured.

That is, in the case of the pointer 24, when the first to fifth fiber sheets 25 to 29 having the carbon fibers 25*a* to 29*a* arranged in one direction are to be laminated together to form the material sheet 30, the arrangement direction of the carbon fibers 27*a* of the third fiber sheet 27 positioned in the middle among the carbon fibers 25*a* to 29*a* is varied with respect to the arrangement direction of the carbon fibers 25*a*, 26*a*, 28*a*, and 29*a* of the other fiber sheets 25, 26, 28, and 29. Therefore, compared with the case where the pointer body 2 is structured of one fiber sheet, the strength of the pointer body 2 can be reliably enhanced, and the impact resistance can also be enhanced, as in the case of the first embodiment.

Also, in the case of the pointer 24, the first to fifth fiber sheets 25 to 29 are formed with the carbon fibers 25*a* to 29*a* being arranged in one direction, whereby the thickness T2 of each of the first to fifth fiber sheets 25 to 29 can be thinned. As a result, as with the first embodiment, the thickness and weight of the whole pointer body 2 can be reduced. Accordingly, power consumption when the pointer body 2 is moved can be reduced, which extends the life of the battery. In addition, the size of the pointer body 2 can be increased, and the shape of the pointer body 2 can be freely formed.

In this case, in the material sheet 30, when the first to fifth fiber sheets 25 to 29 are vertically divided into two in the laminating direction, the arrangement state of the carbon fibers 25*a* to 27*a* of the first to third fiber sheets 25 to 27 positioned on the upper layer side and the arrangement state of the carbon fibers 27*a* to 29*a* of the third to fifth fiber sheets 27 to 29 positioned on the lower layer side are identical to each other. Therefore, even when the first to fifth fiber sheets 25 to 29 are laminated together to form the pointer body 2 with, the arrangement direction of the carbon fibers 27*a* of the third fiber sheet 27 positioned in the middle among the carbon fibers 25*a* to 29*a* being varied, deformation such as warpage, sag, or twist of the pointer body 2 can be suppressed, whereby the pointer bodies 2 can be kept to have a uniform shape.

That is, in the material sheet 30, even if the arrangement directions of the first to fifth carbon fibers 25*a* to 29*a* are varied when the first to fifth fiber sheets 25 to 29 are laminated together to form the pointer body 2, the arrangement state of the carbon fibers 25*a* and 27*a* of the first to third fiber sheets 25 and 27 positioned on the upper layer side obtained by division into two in the laminating direction and the arrangement state of the carbon fibers 27*a* to 29*a* of the third to fifth fiber sheets 27 to 29 positioned on the lower layer side are identical to each other, whereby an imbalance in strength between the upper layer side and the lower layer side due to the varied arrangement directions of the carbon fibers 25*a* to 29*a* can be cancelled out. As a result, deformation such as warpage, sag, or twist of the pointer body 2 due to the varied arrangement directions of the carbon fibers 25*a* to 29*a* can be reliably suppressed.

Moreover, the material sheet 30 is formed by laminating the first to fifth fiber sheets 25 to 29 together in five layers. The first and second fiber sheets 25 and 26 on the upper layer side and the fourth and fifth fiber sheets 28 and 29 on the lower layer side have the respective carbon fibers 25*a* and 26*a*, and 28*a* and 29*a* arranged in the same arrangement direction. The third fiber sheet 27 positioned in the middle has the carbon fibers 27*a* arranged in a direction orthogonal to the arrangement direction of the carbon fibers 25*a*, 26*a*, 28*a*, and 29*a* in the first and second fiber sheets 25 and 26 on the upper layer side and the fourth and fifth fiber sheets 28 and 29 on the lower layer side. Therefore, the arrangement state of the carbon fibers 25*a* to 27*a* on the upper layer side and the arrangement state of the carbon fibers 27*a* to 29*a* on the lower layer side can be made identical to each other.

As a result, in the pointer 24, the strength of the pointer body 2 can be enhanced, and deformation such as warpage, sag, or twist of the pointer body 2 can be suppressed. That is, warpage and sag due to the insufficiency of stiffness of the pointer body 2 can be prevented, whereby the productivity can be improved. Also, deformation such as warpage by heat at the time of processing the outer shape by laser processing on the material sheet 30 can be suppressed. In addition, deformation such as warpage due to stress at the time of mounting the pointer body 2 on the mount piece 4 for mounting the pointer body 2 on the pointer shaft 3 by swaging can also be reliably and favorably suppressed.

In this case, the first and second fiber sheets 25 and 26 on the upper layer side and the fourth and fifth fiber sheets 28 and 29 on the lower layer side have the respective carbon fibers 25*a*, 26*a*, 28*a*, and 29*a* arranged in a direction parallel to the longitudinal direction of the pointer body 2. As a result, the strength of the pointer body 2 in the longitudinal direction can be enhanced and whereby warped deformation of the pointer body in the longitudinal direction can be reliably and favorably suppressed.

Furthermore, the third fiber sheet 27 positioned in the middle has the carbon fibers 27*a* arranged in a direction orthogonal to the longitudinal direction of the pointer body 2, whereby the strength of the pointer body 2 in the twisting direction can be enhanced. As a result, deformation in the twisting direction of the pointer body 2 can be suppressed. Accordingly, in this pointer 15 as well, strength against various types of deformation of the pointer body 2 such as warpage, sag, or twist can be sufficiently enhanced.

In this case as well, the pointer 24 has the pointer body 2 coated with the coating film 10, whereby the entire surface of the pointer body 2 can be protected with the coating film 10, as with the first embodiment. In this case, when the material sheet 30 in which the first to fifth fiber sheets 25 to 29 have been laminated together is cut to form the pointer body 2, the coating film 10 can reliably prevent the end face of each of the cut carbon fibers 25*a* to 29*a* from falling from the perimeter of the pointer body 2 as fine fragments, whereby the pointer body 2 can be favorably protected.

Still further, in the pointer 24, the print layer 31 is provided on the upper surface and the lower surface of the pointer body 2, whereby the upper surface side of the pointer body 2 can be decorated with the print layer 31 so that the design can be improved. In this case, if the print layer 31 is provided on the upper surface side of the pointer body 2, warped deformation of the pointer body 2 occurs upward due to shrinkage of ink of the print layer 31. However, by providing the print layer 31 on the lower surface side of the pointer body 2, the warpage of the pointer body 2 can be cancelled out. Also, by using different colors for the print layers 31 on the upper surface and the lower surface of the pointer body 2, the upper surface and the lower surface of the pointer body 2 can be differentiated, whereby the mounting operability of the pointer body 2 with respect to the pointer shaft 3 can be improved.

In the above-described third embodiment, the print layer 31 is provided on the surface of the coating film 10. However, the present invention is not limited thereto, and a structure may be adopted in which the print layer 31 is directly provided on the upper surface and the lower surface of the pointer body 2, and the print layer 31 and the first to fifth fiber sheets 25 to 29 are covered with the transparent coating film 10. In this case, the print layer 31 can be provided in advance to each of the upper surface and the lower surface of the material sheet 30, whereby the productivity can be improved. Also, the print layer 31 described in the third embodiment may be provided in the first embodiment or the second embodiment.

Moreover, in each of the above-described first to third embodiments, the fiber sheets 6 to 8, 16 to 19, and 25 to 29 are laminated together such that the arrangement directions of the carbon fibers 6*a*, 8*a*, 16*a*, 19*a*, 25*a*, 26*a*, 28*a*, and 29*a* in the fiber sheets 6, 16, 25, and 26 on the upper layer side and the fiber sheets 8, 19, 28, and 29 on the lower layer side and the arrangement directions of the carbon fibers 7*a*, 17*a*, 18*a*, and 27*a* of the fiber sheets 7, 17, 18, and 27, positioned in the middle are orthogonal to each other. However, these directions are not necessarily orthogonal to each other, and may cross at a predetermined angle.

That is a structure may be adopted in which a plurality of fiber sheets are laminated together to form a material sheet such that the arrangement directions of the carbon fibers of the fiber sheets on the upper layer side and the fiber sheets on the lower layer side and the arrangement direction of the carbon fibers of the fiber sheet serving as the intermediate layer crosses at a predetermined angle, such as an angle of 45 degrees. In this case as well, the material sheet may be structured in any manner as long as the arrangement state of the carbon fibers positioned on the upper layer side and the arrangement state of the carbon fibers positioned on the lower layer side are the same when the plurality of fiber sheets are vertically divided into two in the laminating direction.

Furthermore, in each of the above-described first to third embodiments, the pointer body 2 has the arrow mark section 2*a* formed on one end thereof (in FIG. 1, the right end), the narrow-width section 2*b* is formed to be elongated from the arrow mark section 2*a* toward the other end (in FIG. 1, toward the left end), and the wide-width section 2*c* is formed from the elongated narrow-width section 2*b* toward the other end. However, the present invention is not limited thereto, and the pointer body may be formed in an arbitrary shape.

Still further, in each of the above-described first to third embodiments, the present invention has been applied to a wristwatch. However, the present invention is not necessarily applied to a wristwatch, and can be applied to various timepieces, such as a travel watch, an alarm clock, a desk clock, and a wall clock. Also, the present invention is not necessarily applied to a timepiece, and can be applied to a pointer of any measuring instrument such as a meter.

While the present invention has been described with reference to the preferred embodiments, it is intended that the invention be not limited by any of the details of the description therein but includes all the embodiments which fall within the scope of the appended claims.

What is claimed is:

1. A pointer comprising:

a pointer body made of a material sheet, the material sheet comprising a plurality of fiber sheets laminated together;

wherein each of the fiber sheets includes carbon fibers arranged in one direction;

wherein the fiber sheets are laminated such that arrangement directions of the carbon fibers are varied among the fiber sheets;

wherein the material sheet is formed by laminating three fiber sheets, an arrangement direction of each carbon fiber in an uppermost fiber sheet and an arrangement direction of each carbon fiber in a lowermost fiber sheet being a same first direction, and an arrangement direction of each carbon fiber in a middle fiber sheet of the three fiber sheets being a second direction orthogonal to the first direction;

wherein among the plurality of fiber sheets, the uppermost fiber sheet and the lowermost fiber sheet are arranged such that the arrangement direction of each carbon fiber in the uppermost fiber sheet and the arrangement direction of each carbon fiber in the lowermost fiber sheet is parallel to a longitudinal direction of the pointer body;

wherein the arrangement direction of each carbon fiber in the middle fiber sheet is orthogonal to the longitudinal direction of the pointer body;

wherein the pointer body is coated with a single coating film that covers all surfaces of the material sheet of the pointer body; wherein the pointer body includes a first print layer provided on an upper surface of the pointer body, and a second print layer provided on a lower surface of the pointer body; and wherein the first print layer and the second print layer have a same ink and a same thickness so as to have a same ink shrinkage ratio at the upper and lower surfaces of the pointer body.

2. The pointer according to claim 1, wherein the fiber sheets are laminated such that, if the material sheet is vertically divided in two into an upper portion and a lower portion in a laminating direction of the fiber sheets, an arrangement state of the carbon fibers in the fiber sheets in the lower portion is identical to an arrangement state of the carbon fibers in the fiber sheets in the upper portion.

3. A pointer comprising:

a pointer body made of a material sheet, the material sheet comprising a plurality of fiber sheets laminated together;

wherein each of the fiber sheets includes carbon fibers arranged in one direction;

wherein the fiber sheets are laminated such that arrangement directions of the carbon fibers are varied among the fiber sheets;

wherein the material sheet is formed by laminating four fiber sheets, an arrangement direction of each carbon fiber in an uppermost fiber sheet and an arrangement direction of each carbon fiber in a lowermost fiber sheet being a same first direction, and an arrangement direction of each carbon fiber in each of two middle fiber sheets of the four fiber sheets being a second direction orthogonal to the first direction;

wherein among the plurality of fiber sheets, the uppermost fiber sheet and the lowermost fiber sheet are arranged such that the arrangement direction of each carbon fiber in the uppermost fiber sheet and the arrangement direction of each carbon fiber in the lowermost fiber sheet is parallel to a longitudinal direction of the pointer body;

wherein the arrangement direction of each carbon fiber in each of the two middle fiber sheets is orthogonal to the longitudinal direction of the pointer body;

wherein the pointer body is coated with a single coating film that covers all surfaces of the material sheet of the pointer body; wherein the pointer body includes a first print layer provided on an upper surface of the pointer body, and a second print layer provided on a lower surface of the pointer body; and wherein the first print layer and the second print layer have a same ink and a same thickness so as to have a same ink shrinkage ratio at the upper and lower surfaces of the pointer body.

4. A pointer comprising:

a pointer body made of a material sheet, the material sheet comprising a plurality of fiber sheets laminated together;

wherein each of the fiber sheets includes carbon fibers arranged in one direction;

wherein the fiber sheets are laminated such that arrangement directions of the carbon fibers are varied among the fiber sheets;

wherein the material sheet is formed by laminating five fiber sheets;

wherein an arrangement direction of each carbon fiber in each of two uppermost fiber sheets of the five fiber sheets and an arrangement direction of each carbon fiber in each of two lowermost fiber sheets of the five fiber sheets is a same first direction, and an arrangement direction of each carbon fiber in a middle fiber sheet of the five fiber sheets is a second direction orthogonal to the first direction;

wherein the arrangement direction of each carbon fiber in each of the two uppermost fiber sheets and the arrangement direction of each carbon fiber in each of the two lowermost fiber sheets is parallel to the longitudinal direction of the pointer body;

wherein the arrangement direction of each carbon fiber in the middle fiber sheet is orthogonal to the longitudinal direction of the pointer body;

wherein the pointer body is coated with a single coating film that covers all surfaces of the material sheet of the pointer body wherein the pointer body includes a first print layer provided on an upper surface of the pointer body, and a second print layer provided on a lower surface of the pointer body; and wherein the first print layer and the second print layer have a same ink and a same thickness so as to have a same ink shrinkage ratio at the upper and lower surfaces of the pointer body.

5. The pointer according to claim 1, further comprising:

a mount piece for mounting the pointer body on a pointer shaft, wherein the mount piece includes:

a cylindrical section which is inserted into a mount hole of the pointer body to fit into the pointer shaft;

a presser section which is provided on an upper end of the cylindrical section to press an upper surface of the pointer body;

a washer section which is inserted on a lower end of the cylindrical section to be placed on a lower surface of the pointer body; and a swaged section which is provided at the lower end of the cylindrical section to press the washer section against the lower surface of the pointer body.

6. The pointer according to claim 1, wherein the first print layer and the second print layer are provided over the coating film.

7. The pointer according to claim 3, wherein the first print layer and the second print layer are provided over the coating film.

8. The pointer according to claim 4, wherein the first print layer and the second print layer are provided over the coating film.

9. The pointer according to claim 1, wherein the first print layer and the second print layer are provided under the coating film, and wherein the coating film is transparent.

10. The pointer according to claim 3, wherein the first print layer and the second print layer are provided under the coating film, and wherein the coating film is transparent.

11. The pointer according to claim 4, wherein the first print layer and the second print layer are provided under the coating film, and wherein the coating film is transparent.

* * * * *